US005275239A

United States Patent [19]

Obrejanu

[11] Patent Number: 5,275,239

[45] Date of Patent: Jan. 4, 1994

[54] ANCHORING DEVICE FOR TUBING STRING

[75] Inventor: Marcel Obrejanu, Calgary, Canada

[73] Assignee: Valmar Consulting Ltd., Calgary, Canada

[21] Appl. No.: 830,908

[22] Filed: Feb. 4, 1992

[51] Int. Cl.[5] ..... F21B 23/00

[52] U.S. Cl. ..... 166/210; 166/211; 166/215; 166/242

[58] Field of Search ..... 166/88, 97, 208, 209, 166/210, 216; 175/73, 94

[56] References Cited

U.S. PATENT DOCUMENTS

| | | | |
|---|---|---|---|
| 2,119,763 | 7/1935 | Wilson | 166/210 |
| 2,849,069 | 8/1958 | Baker et al. | 166/210 |
| 2,965,177 | 12/1960 | Le Bus, Sr. et al. | 166/209 |
| 3,279,542 | 10/1966 | Brown . | |
| 3,556,216 | 1/1971 | Condra . | |
| 3,664,417 | 5/1972 | Conrad | 166/216 |
| 3,705,624 | 12/1972 | Pitts | 166/216 |
| 4,317,485 | 3/1982 | Ross | 166/216 |
| 4,340,116 | 7/1982 | Weise . | |
| 4,489,781 | 12/1984 | Weeks . | |
| 4,496,000 | 1/1985 | Weeks . | |
| 4,580,631 | 4/1986 | Baugh . | |
| 4,605,062 | 8/1986 | Klumpyan . | |
| 4,669,555 | 6/1987 | Petree . | |
| 4,811,785 | 3/1989 | Weber | 166/210 |
| 4,901,793 | 2/1990 | Weber | 166/210 |

FOREIGN PATENT DOCUMENTS

| | | |
|---|---|---|
| 1081613 | 7/1980 | Canada . |
| 1147258 | 5/1983 | Canada . |
| 1162845 | 2/1984 | Canada . |
| 1180594 | 1/1985 | Canada . |

*Primary Examiner*—Ramon S. Britts
*Assistant Examiner*—Frank S. Tsay
*Attorney, Agent, or Firm*—Mirek A. Waraksa

[57] ABSTRACT

A device anchors a tubing string within a stationary well casing against rotation in a predetermined angular direction. A housing is installed in-line in the tubing string. Anchoring mechanisms are spaced circumferentially about the housing. Each anchoring mechanism includes a recess and an anchoring member free-floating within the recess. The anchoring member has a fulcrum portion and a bite portion external to the recess. Retaining rings partially overlaying the recess prevent the anchoring member from escaping. A spring urges the anchoring member against the retaining rings and urges the bite portion to contact the well casing such that rotation of the tubing string displaces the anchoring member. Rotation of the tubing string in the predetermined direction seats the fulcrum portion in a seating structure within the recess and causes the bite portion to bite into the well casing, locking against further rotation. Rotation of the tubing string in an opposite direction displaces the anchoring member to a non-locking orientation in which the bite portion slides relative to the well casing.

9 Claims, 4 Drawing Sheets

ANCHORING DEVICE FOR TUBING STRING

FIELD OF THE INVENTION

The invention relates to devices for anchoring a tubing string to a surrounding well casing.

BACKGROUND OF THE INVENTION

A tubing string is commonly used to collect oil from a below-surface reservoir. The tubing string is conventionally constructed in threaded sections. With low-pressure reservoirs, a pump will be installed in-line in the tubing string to force the oil upwardly to the surface. A common pump configuration has a stator threaded into the tubing string and an internal spiral-like rotor oriented with the direction of the tubing string. The forces required to rotate the rotor in one angular direction to pump oil to the surface are reacted in an opposite direction through the stator into the tubing string. This tends to rotate the tubing string, which is undesirable.

An anchoring device for preventing such rotation of a tubing string is commercially available and described in U.S. Pat. No. 4,901,793 to Weber. The device has an outer cylindrical housing and an inner mandrel, which rotate relative to one another. Upper and lower ends of the mandrel are threaded in a standard manner into the tubing string. Four spring-biased drags extend from the housing to anchor it to the stationary well casing. Displaceable slips are located within the housing. A mechanical linkage internal to the housing displaces the slips to and from the well casing in response to rotation of the mandrel. To engage the slips with the well casing, the entire tubing string may be appropriately rotated in a particular angular direction from the surface. To disengage the slips, the tubing string is rotated in an opposite direction. The slips lock to the well casing when the tubing string rotates in the same direction that the associated pump. The prior device has on at least one occasion failed to disengage from the well casing. To release the device, components in the mechanical linkage apparently had to be sheared, and a drag was apparently lost.

The present invention provides a simple and reliable device for anchoring a tubing string to a well casing. At least in preferred form, the anchoring device can readily disengage from the well casing and is less subject to damage.

SUMMARY OF THE INVENTION

In one aspect, the invention provides a device for anchoring a tubing string within a stationary well casing against rotation in a predetermined angular direction. The anchoring device includes a housing adapted for installation in-line in the tubing string. A plurality of anchoring mechanisms are spaced circumferentially about the housing. Each anchoring mechanisms comprises a recess in the exterior of the housing. The anchoring member comprising a bite portion that extends external of the recess. The anchoring member is shaped for displacement between a locking orientation in which the bite portion bites into the well casing and the anchoring member acts between the well casing and the housing to prevent rotation of the housing and a non-locking orientation in which the bite portion slides relative to the well casing to allow rotation of the housing. Retaining means prevent the anchoring member from escaping from the recess. Spring means urge the bite portion into contact with the well casing. Rotation of the housing relative to the well casing in the predetermined angular direction displaces the anchoring member to its locking orientation, resisting further rotation of the tubing string in the predetermined direction, and rotation of the housing relative to the well casing in the opposite angular direction displaces the anchoring member to its non-locking orientation, allowing such rotation of the tubing string.

In a preferred form of the invention, each anchoring member is free-floating within its associated recess. The term "free-floating" as used in this specification in respect of an anchoring member indicates that the anchoring member is a separate component that is free both to rotate and translate within the associated recess. The retaining means may simply be structures that partially overlay the recess, and the spring means may incidentally urge the anchoring member against the retaining means when the anchoring member is in its non-locking orientation. The spring means simply resist and bias movement of the anchoring member.

In the preferred form, a seating structure may be formed in the associated recess to receive a fulcrum portion of the free-floating anchoring member. In the locking orientation, the fulcrum portion seats in the seating structure and the bite portion simultaneously bites into the well casing. In the non-locking orientation, the fulcrum portion is spaced outwardly from the seating structure and is rotated in the predetermined angular direction relative to the seating structure. The spring-biased contact between the bite portion and the well casing causes the anchoring member to rotate in an angular direction opposite to whatever direction the tubing string and housing are rotated. When the tubing string is rotated in the predetermined angular direction, the anchoring member is rotated in the opposite direction and translated inwardly to its locking orientation. When the tubing string is rotated in the opposite angular direction, the anchoring member rotates in the predetermined angular direction and translates outwardly (in part under the influence of the spring means), back to its non-locking orientation. The advantage of this arrangement is that the anchoring members can readily release from the well casing, and there are no pins or mechanical linkages that are potentially subject to shearing or breakage.

These and other aspects of the invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
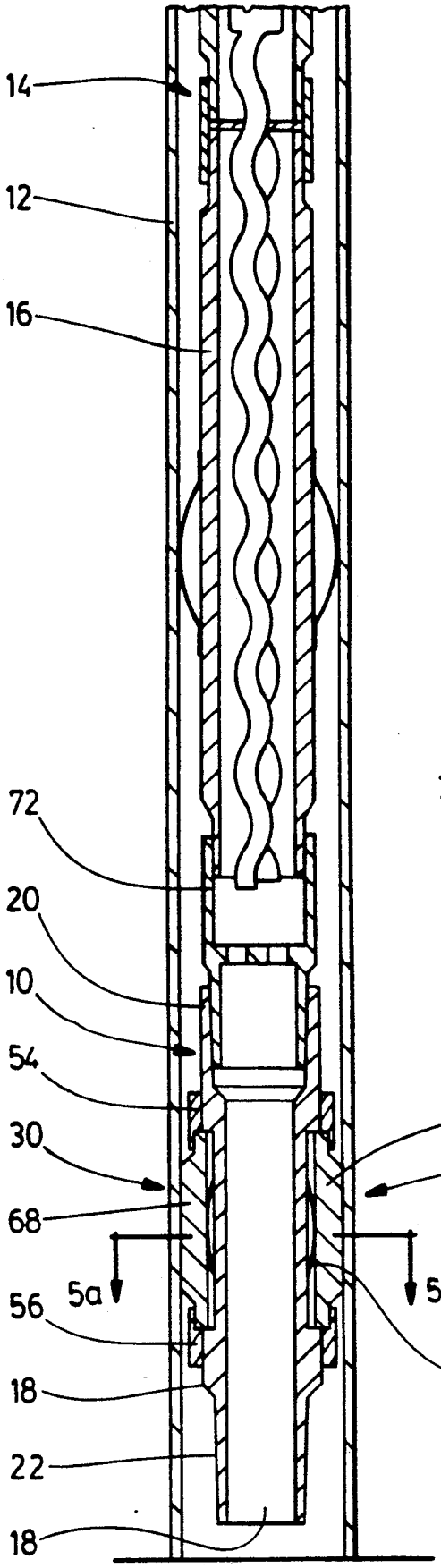
FIG. 1 is a diagrammatic cross-section in a vertical plane, stripped of detail, of an anchoring device located within a well casing.

Reference is made to FIG. 1 which shows an anchoring device 10 within a stationary well casing 12. The anchoring device 10 is installed in-line in a production tubing string 14 extending substantially centrally through the interior of the well casing 12. In this particular application, the anchoring device 10 has been positioned immediately below a progressive cavity pump 16 (also installed in-line in the tubing string 14). Pump operation tends to rotate the tubing string 14 clockwise (as viewed from above). The anchoring device 10 is designed to resist such rotation in a manner described more fully below.

Figure 5A:
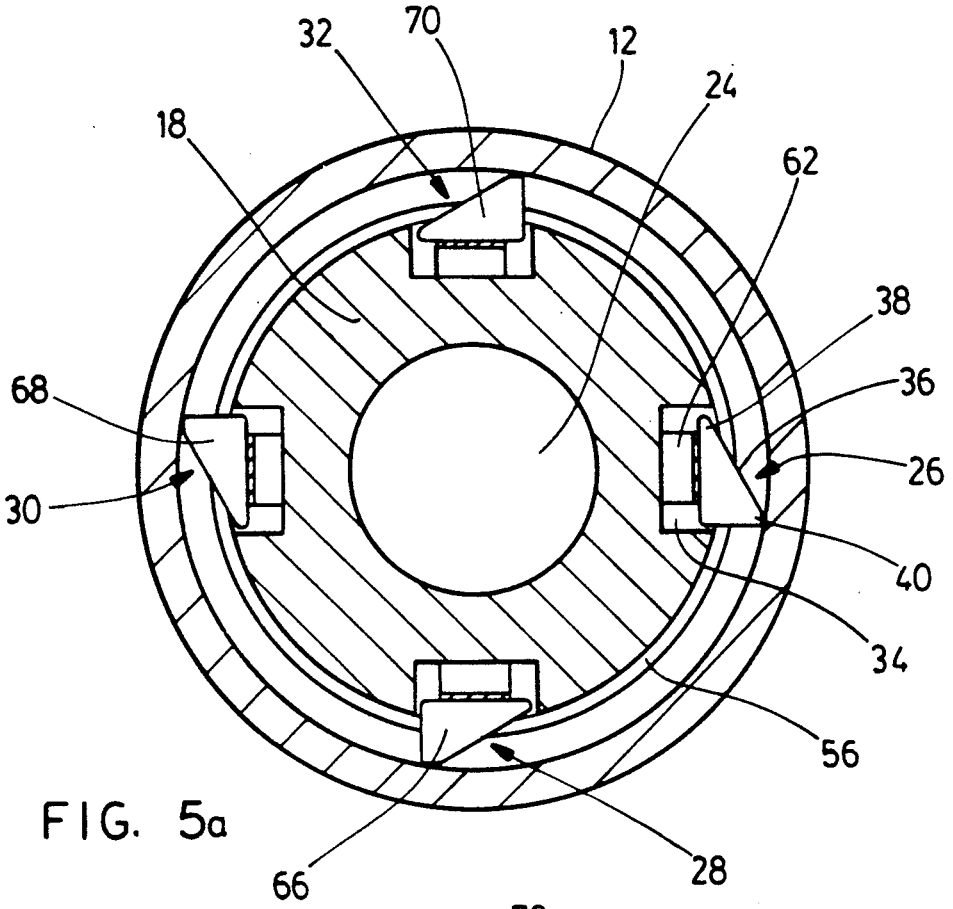
FIGS. 5*a* and 5*b* are horizontal sectional views through the anchoring device respectively showing it unlocked from the well casing and locked to the well casing to resist rotation of the associated tubing string.
Figure 5B:
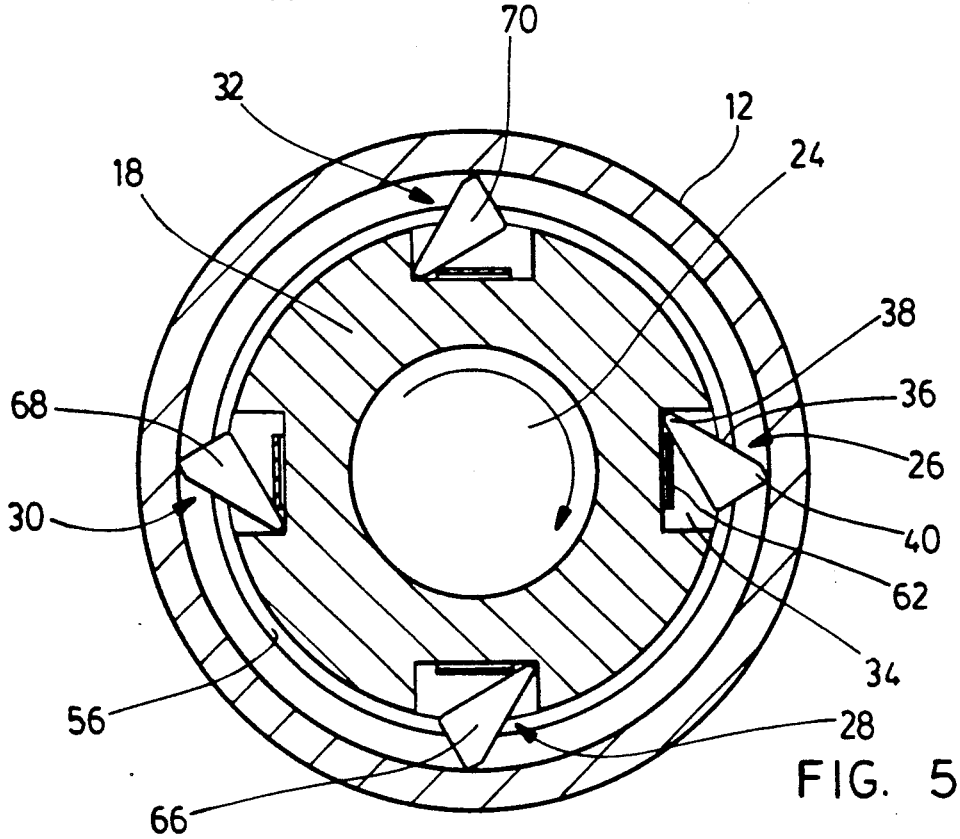

The anchoring device 10 comprises a generally cylindrical housing 18. Standard threaded fittings 20, 22 adapt the housing 18 for in-line installation. The housing 18 has a hollow interior 24 that permits pumping of oil through the anchoring device 10 itself. Four identical anchoring mechanisms 26, 28, 30, 32 are equally-spaced circumferentially about the exterior of the housing 18. All four anchoring mechanism 26, 28, 30, 32 are shown in FIGS. 5*a* and 5*b*.

Figure 2:
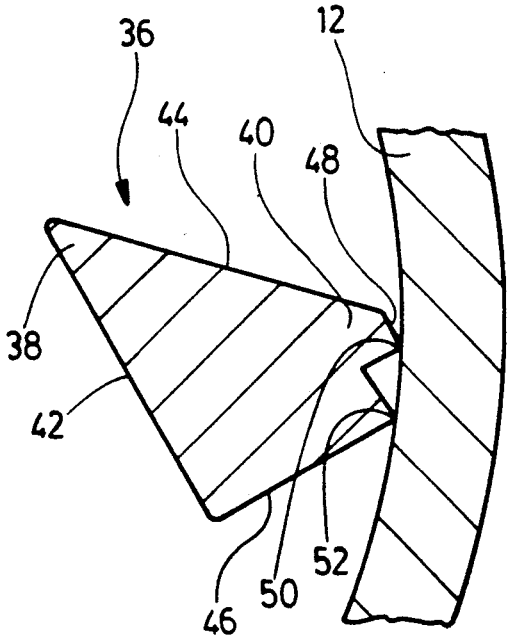
FIG. 2 is an fragmented cross-sectional view of an anchoring member of the anchoring device cooperating with the well casing.

The mechanism 26 is typical. It comprises a vertical or axially-directed recess 34 of generally rectangular shape formed in the exterior of the housing 18. An anchoring member 36 is located within the recess 34. As apparent from FIGS. 4, 5*a* and 5*b*, the majority of the elongate body of the anchoring member 36 has a generally triangular cross-section with three apex portions. One apex portion constitutes a fulcrum portion 38 and another constitutes a bite portion 40, the bite portion 40 extending externally of the recess 34. It has a base surface 42 and a pair of side surfaces 44, 46, one on either side of the base surface 42 and both extending to the bite portion 40. The exact shape of the bite portion 40 is shown only in the enlarged cross-sectional view of FIG. 2. The bite portion 40 defines a flat sliding surface 48 and a pair of cutting edges 50, 52. (In FIGS. 5*a* and 5*b*, the cutting edges 50, 52 have been omitted because of the scale of the drawings.) The cutting edges 50, 52 are spaced in a clockwise direction from the sliding surface 48. As discussed more fully below, counter-clockwise rotation of the anchoring member 34 tends to engage the cutting edges 50, 52 with the well casing 12 while clockwise rotation tends to disengage the cutting edges 50, 52 and engage the sliding surface 48 with the well casing 12.

Figure 3:
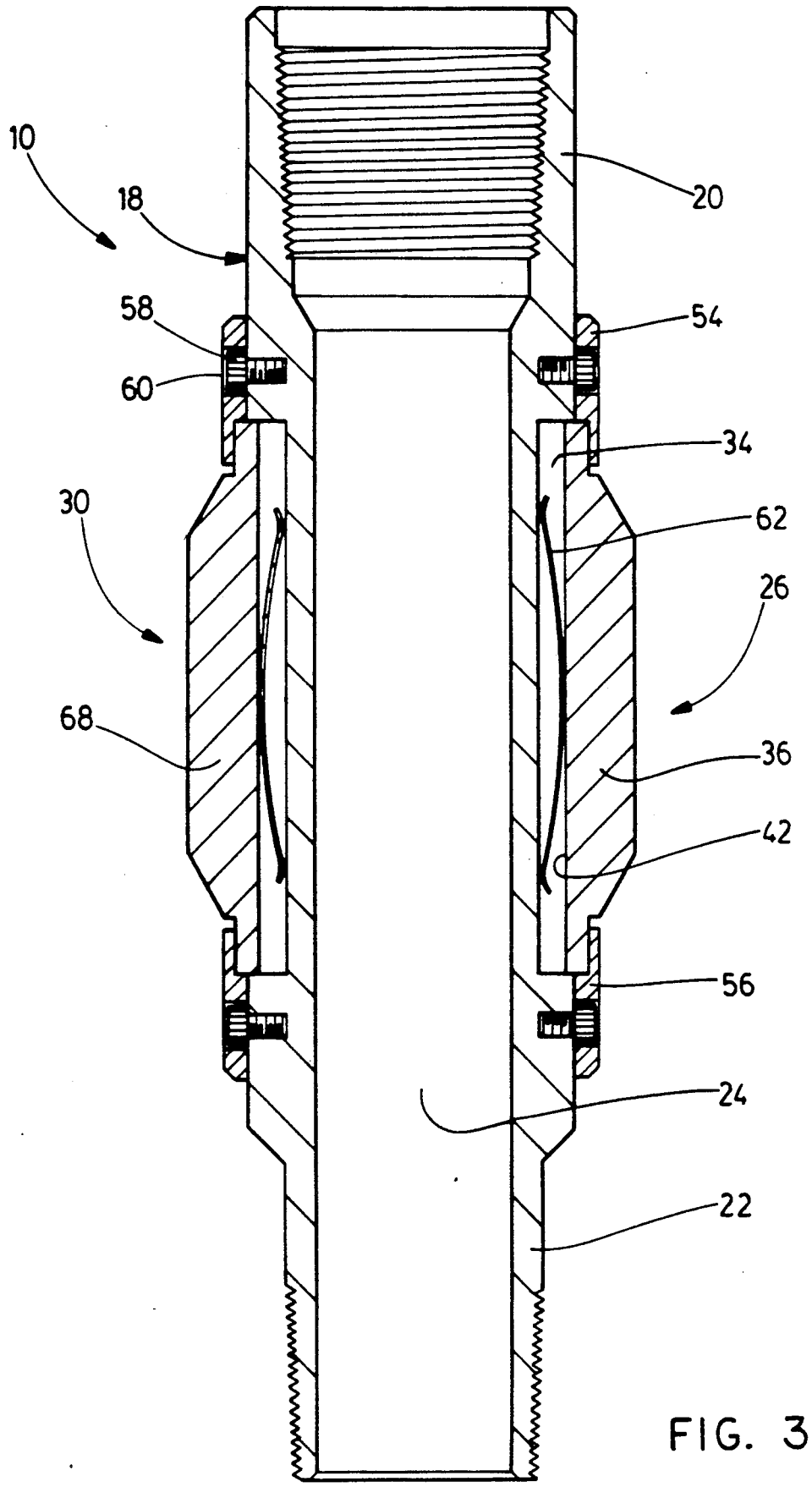
FIG. 3 is a cross-section in a vertical plane of the anchoring device.
Figure 4:
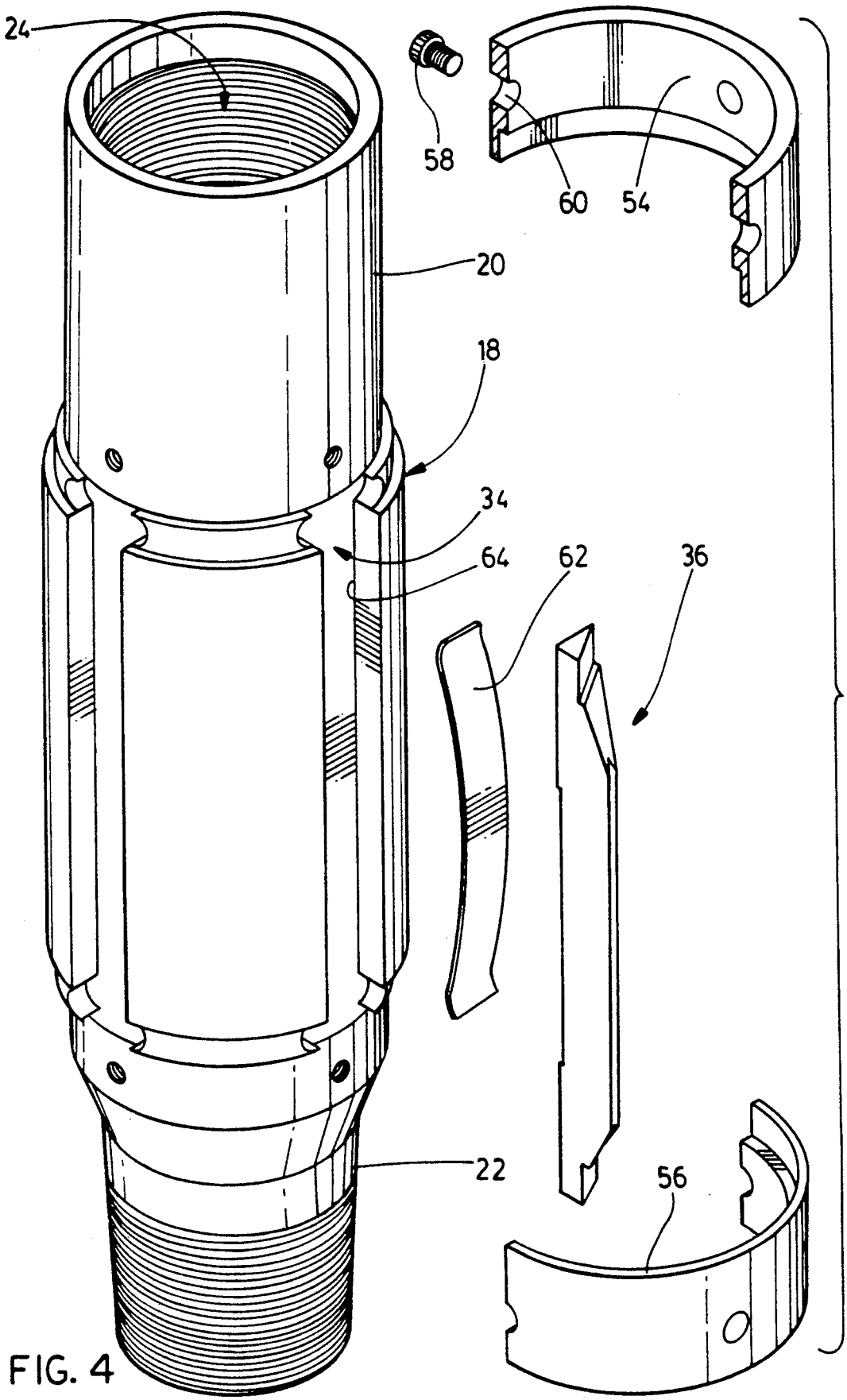
FIG. 4 is a partially exploded perspective view of the anchoring device.

The anchoring member 36 is free-floating within the recess 34. Upper and lower retaining rings 54, 56 prevent the anchoring member 36 from escaping from the recess 34. The rings 54, 56 encircle the housing 18 and are secured with bolts that extend into clearance holes in the rings 54, 56 and thread into the housing 18. The bolt 58 and clearance opening 60 illustrated in FIGS. 3 and 4 are typical. The rings 54, 56 extend partially over the recess 34, the upper ring 54 overlaying an upper end of the recess 34, the lower ring 56 overlaying an opposite lower end of the recess 34. A bowed spring 62 is located between the anchoring member 36 and the bottom of the recess 34. It acts between the housing 18 and the anchoring member 36, specifically its base surface 42, to urge the anchoring member 36 outwardly against the retaining rings. Most significantly, the spring 62 urges the bite portion 40 to contact the well casing 12.

Contact between the bite portion 40 and the well casing 12 displaces the anchoring member 36 in response to rotation of the housing 18, which tends to rotate with the tubing string 14. The anchoring member 36 tends to rotate in a direction opposite to that of the tubing string 14 and housing 18. The contact also produces inward and outward translation of the anchoring member 36 (under the influence of the spring 62). As discussed more fully below, this is exploited to displace the anchoring member 36 between a locking orientation (as in FIGS. 2 and 5*b*) which resists clockwise rotation of the tubing string 14 and a non-locking orientation which allows counter-clockwise rotation of the tubing string 14.

In response to rotation of the housing 18 clockwise, the anchoring member 36 rotates counter-clockwise and translates inwardly (overcoming the biasing force of the spring 62) to its locking orientation. As the anchoring member 36 approaches its locking orientation, its fulcrum portion 38 seats in a seating structure 64 (essentially a corner of the recess 34). Its bite portion 40 then tends to rotate about its fulcrum portion 38 until the bite portion's cutting edges 50, 52 bite firmly into the well casing 12. This locks the housing 18 and tubing string 14 against further clockwise rotation. As apparent in FIG. 5*a*, the anchoring members 66, 68, 70 of the other anchoring mechanisms 28, 30, 32 operate simultaneously in a similar manner.

If the housing 18 is then rotated in an opposite angular direction (counterclockwise), the anchoring mechanism is restored to its non-locking orientation. Such counter-clockwise rotation can be initiated at the surface by rotating the tubing string 14, as when the tubing string 14 is to be withdrawn. The bite portion 40 responds initially by rotating about the fulcrum portion 38 in the clockwise direction, disengaging the cutting edges 50, 52 and contacting the sliding surface 48 of the bite portion 40 with the well casing 12. The sliding surface 48 defines essentially a cord of the inner circumference of the well casing 12, and exposes no sharp edges so that the anchoring member 36 is free to slide relative to the well casing 12. As apparent in FIG. 5*b*, the anchoring members 66, 68, 70 of the other anchoring mechanisms 28, 30, 32 simultaneously release and slide in a similar manner.

How the anchoring device 10 is installed and located at its below-surface position in the well casing 12 will be briefly described. The anchoring device 10 is introduced into the well casing 12 at the surface. The anchoring device 10 is held stationary, and the next section of the tubing string 14, the pump 16, is threaded to the housing 18 of the anchoring device 10 (through an appropriate coupler 72). Succeeding tube sections are threaded into the tubing string 14, and the assembly is lowered in a conventional manner along the well casing 12. Should locking occur during installation, the tubing string 14 can be rotated counter-clockwise to release the anchoring mechanisms 26, 28, 30, 32. Once the anchoring device 10 and pump 16 are at the desired depth, the tubing string 14 can be rotated clockwise from the surface to place the anchoring mechanisms 26, 28, 30, 32 in their locking orientation. Operation of the pump 16 would in any event produce such a locking. To release the anchoring device 10, the tubing string 14 is simply rotated counter-clockwise from the surface. The free-floating nature of the anchoring members 36, 66, 68, 70 ensures reliable disengagement from the well casing 12, with little risk of damaging components.

Certain details of the preferred embodiment are not critical to broader aspects of the invention. For example, each anchoring member could be retained with a pivot pin fixed to the housing 18. The motion of each anchoring member in response to rotation of the tubing string 14, between locking and non-locking orientations, would then be purely rotational. Such pinning is not preferred, as the pin is subjected to significant shearing forces that can lead to device failure. The construction of the bite portion of each anchoring member is not particularly critical. The bite portion 40 of the anchoring member 36 uses sharp cutting edges 50, 52, but any shape or construction that can grip the well casing 12 is appropriate. With a free-floating anchoring member, seating of a distinct fulcrum portion in the distinct seating structure is preferred. However, such an anchoring member and associated recess need only have shapes that cooperate to halt rotation and translation of the anchoring member when the anchoring member achieves its locking orientation.

It will be apparent that other modifications may be made within the spirit of the invention and without necessarily departing from the scope of the appended claims.

I claim:

1. A device for anchoring a tubing string within a stationary well casing against rotation in a predetermined angular direction, comprising:

a housing adapted to be installed in-line in the tubing string for rotation with the tubing string and having an exterior;

a plurality of anchoring mechanisms spaced circumferentially about the housing, each of the anchoring mechanisms comprising:

(a) a recess in the exterior of the housing;

(b) an anchoring member within the recess and comprising a bite portion external to the recess, the anchoring member being shaped for displacement at least by rotation relative to the recess between a locking orientation in which the bite portion bites into the well casing and the anchoring member acts between the well casing and the housing to prevent rotation of the housing and a non-locking orientation in which the bite portion slides against the well casing in response to rotation of the housing in an opposite angular direction;

(c) retaining means preventing the anchoring member from escaping from the recess; and, (d) spring means acting between the housing and the anchoring member for urging the bite portion into contact with the well casing such that rotation of the housing relative to the well casing in the predetermined angular direction displaces the anchoring member to its locking orientation and rotation of the housing relative to the well casing in the opposite angular direction displaces the anchoring member to its non-locking orientation.

2. The device of claim 1 in which in each of the anchoring mechanisms:

the anchoring member is free-floating within the chamber; and, the retaining means partially overlay the recess; and, the spring means urge the anchoring member outwardly against the retaining means.

3. The device of claim 2 in which in each of the anchoring mechanisms:

the housing defines a seating structure within the recess;

the anchoring member comprises a fulcrum portion spaced from the bite portion;

the anchoring member is shaped such that the fulcrum portion seats in the seating structure in the locking orientation of the anchoring member.

4. The device of claim 3 in which in each of the anchoring mechanisms:

the bite portion defines a cutting edge;

the cutting edge is positioned on the bite portion such that, when the fulcrum portion seats in the seating structure, rotation of the anchoring member in the opposite direction about the fulcrum portion drives the cutting edge into the well casing and rotation of the anchoring member about the fulcrum portion in the predetermined direction releases the cutting edge from the well casing.

5. A device for anchoring a tubing string within a stationary well casing against rotation in a predetermined angular direction, comprising:

a housing adapted to be installed in-line in the tubing string for rotation with the tubing string and having an exterior;

a plurality of anchoring mechanisms spaced circumferentially about the housing, each of the anchoring mechanisms comprising:

(a) a recess in the exterior of the housing;

(b) a seating structure within the recess;

(c) an anchoring member free-floating within the recess, the anchoring member comprising a fulcrum portion and a bite portion that extends externally of the recess, the anchoring member being shaped for displacement between a locking orientation in which the fulcrum portion seats in the seating structure and the bite portion simultaneously bites into the well casing and a non-locking orientation in which the fulcrum portion is spaced outwardly from and rotated in the predetermined angular direction relative to the seating structure and the bite portion slides relative to the well casing;

(d) retaining means preventing the anchoring member from escaping from the recess; and, (e) spring means acting between the housing and the anchoring member for urging the bite portion into contact with the well casing such that rotation of the housing relative to the well casing in the predetermined angular direction rotates the anchoring member in the opposite angular direction and translates the anchoring member inwardly relative to the recess to the locking orientation and rotation of the housing relative to the well casing in the opposite angular direction rotates and translates the anchoring member from the locking orientation to the non-locking orientation.

6. The device of claim 5 in which in each of the anchoring mechanism:

the anchoring member includes an elongate body portion having a generally triangular transverse cross-section and comprising three apex portions; and, a first of the apex portions defines the fulcrum portion of the anchoring member and a second of the apex portions defines the bite portion.

7. The device of claim 6 in which in each of the anchoring mechanisms:

the anchoring member comprises a base surface extending between the first apex portion and the third apex portion;

the retaining means extend partially over the recess and overlay the anchoring member;

the spring means act between the housing and the base surface of the anchoring member, the spring means urging the anchoring member outwardly against the retaining means.

8. The device of claim 7 in which the retaining means comprise a pair of annular members located about the exterior of the housing, one of the annular members extending over one end of the recess and the other of the annular members extending over an opposite end of the recess.

9. The device of claim 5 in which in each of the anchoring mechanism:

the bite portion defines a sliding surface shaped to slide along the well casing when the housing is rotated in the opposite angular direction and a cutting edge;

the cutting edge is spaced in the predetermined angular direction from the sliding surfaces such that, when the fulcrum portion seats in the seating structure, rotation of the anchoring member in the opposite direction about the fulcrum portion drives the cutting edge into the well casing and subsequent rotation of the anchoring member about the fulcrum portion in the angular direction releases the cutting edge from the well casing.

* * * * *